US007163285B2

(12) United States Patent
Van Doorn et al.

(10) Patent No.: US 7,163,285 B2
(45) Date of Patent: Jan. 16, 2007

(54) AUTOMATIC PRINTER FOR ROLL OF PAPER WEB

(75) Inventors: André Van Doorn, Helmond (NL); Marius P. J. J. R. Ponten, Lierop (NL)

(73) Assignee: OCE-Technologies B.V., Venlo (NL)

( * ) Notice: Subject to any disclaimer, the term of this patent is extended or adjusted under 35 U.S.C. 154(b) by 289 days.

(21) Appl. No.: 10/819,133

(22) Filed: Apr. 7, 2004

(65) Prior Publication Data

US 2004/0252145 A1 Dec. 16, 2004

(30) Foreign Application Priority Data

Apr. 8, 2003 (EP) ..... 03076238.9

(51) Int. Cl.
*B41J 2/01* (2006.01)

(52) U.S. Cl. ..... 347/101; 347/102; 347/104; 347/16

(58) Field of Classification Search ..... 347/101
See application file for complete search history.

(56) References Cited

U.S. PATENT DOCUMENTS 4,539,568 A * 9/1985 Lewis et al. ..... 347/88
6,431,702 B1 * 8/2002 Ruhe ..... 347/102
2002/0171726 A1 * 11/2002 Ishii et al. ..... 347/101

* cited by examiner

*Primary Examiner*—Vip Patel
*Assistant Examiner*—Brian J. Goldberg
(74) *Attorney, Agent, or Firm*—Birch, Stewart, Kolasch and Birch, LLP

(57) ABSTRACT

A printer containing at least one support for a roll of printing paper web, a printer station including a print head, means for conveying the printing paper web from the roll to the printer station, driving means adapted for selectively driving the conveying means in a downstream conveying direction or an upstream conveying direction, a cutting station downstream of the printer station for cutting the printing paper web, means for detecting the passage of an end location on the end portion of the printing paper supplied from the roll and conveyed in the downstream direction to the printer station, controlling means for controlling the print head including means for entering and storing a printing job, the controlling means further including means for receiving a signal from the detecting means indicating the passage of the end location of the roll of the paper web and then to interrupt the printing job and to deactivate the driving means so as to hold the printed paper web upstream of the cutting means for a drying period, and after that drying period to operate the driving means again for conveying the dried paper web portion located upstream of the cutting means in the upstream direction to discharge it from the printer.

11 Claims, 2 Drawing Sheets

AUTOMATIC PRINTER FOR ROLL OF PAPER WEB

This non-provisional application claims priority under 35 U.S.C. § 119(a) on Patent Application No. 03076238.9 filed in Europe on Apr. 8, 2003, which is herein incorporated by reference.

BACKGROUND OF THE INVENTION

The present invention relates to printers and more particularly to printers adapted for printing paper sheet provided on rolls.

Printers adapted for printing paper sheet provided on rolls are used for printing a sequence of printing jobs. The length of paper web required for the total of printing jobs input in the printer will not be matched by the length of the paper web present on the roll. As a consequence, the printer will still be busy performing a printing job when the end of the paper web approaches the print head.

Known printers are provided with a sensor for detecting the end of the paper web and with controlling means for stopping the print head when the paper end web has been detected. The sensor is located at a location between the roll and a first set of paper web driving rolls. A further drive/press roll assembly is arranged directly upstream from the printing station.

After the printer has been stopped the printer must be made ready again for continuing the printing jobs, for which a new roll of paper web has been arranged in the printer (or a second roll already present in the printer is used) and the leading end of the new paper web is fed through the driving rolls and up to the printing station for resuming printing. Before the new paper web can be introduced, the old paper web still present in the printer must be removed from the printer. The old paper web can be conveyed further by the drive/press roll until the end edge has passed that roll. The operator then has to take the end portion from the printer table. This requires special attendance of the operator. In any event, the presence of an operator is required, which makes it impossible to operate the printer in a fully unattended mode for extended periods of use. An object of the present invention is to address this problem.

SUMMARY OF THE INVENTION

Accordingly, an object of the present invention is to provide a printer which can be operated in an unattended mode even during the period of transition from one roll of paper web to a new roll of paper web.

In one aspect, the present invention provides a printer comprising at least one support for a roll of printing paper web, a printer station including a print head, means for conveying the printing paper web from the roll to the printer station, driving means adapted for selectively driving the conveying means in a downstream conveying direction or an upstream conveying direction, a cutting station downstream of the printer station for cutting the printing paper web, means for detecting the passage of an end location on the end portion of the printing paper supplied from the roll and conveyed in the downstream direction to the printer station, controlling means for controlling the print head including means for entering and storing a printing job, the controlling means further including means for receiving a signal from the detecting means indicating the passage of the end location of the roll of the paper web and interrupting the printing job and deactivating the driving means so as to hold the printed paper web upstream of the cutting means for a drying period, and after that drying period has been completed, to operate the driving means again for conveying the dried paper web portion located upstream of the cutting means in an upstream direction to discharge it from the printer.

In the printer according to the present invention the paper web end portion, which is partially printed, can be pulled backwards by the driving means without the risk of the driving surfaces becoming soiled with ink. As a consequence, there is no need, any more, to remove the end paper web portion from the printer table at the downstream side of the printer. Immediately after the driving means has discharged the paper web end portion, a leading end portion of a new roll can be brought into engagement with the drive means in a usual manner, the driving rolls then having been reversed to the normal driving direction. Advantageously, the detecting means are adapted to detect the passage of the end edge of the paper web.

In a further development of the printer according to the invention, the printer is provided with means for sensing the degree of drying of the ink present on the paper web portion to be dried, said sensing means being operatively connected to the controlling means for providing a signal indicating that the ink has dried to a sufficient degree. In this way the drying period will be automatically adjusted to the specific actual conditions and thus be kept as short as possible. By way of example, in the case of hotmelt ink, the drying period can be as large as several minutes, whereas other ink types may have a drying period of several seconds.

Alternatively, or in addition, the controlling means can be provided with means for entering data, such as that relating to the quality of the paper and/or the ink and means for determining the length of the drying period depending on said data. In this case, the operator can input the required data at the beginning of a series of printing jobs requiring more than one roll of paper web and when the end of the paper web has been detected the required drying time will already be fixed and known to the controlling means.

In an advantageous further development of the printer according to the present invention the controlling means are adapted to operate the print head to restart the interrupted printing job for a subsequent roll of printing paper web, after the discharge of said paper web portion of the previous roll. Thus, in this respect, the printer needs no attention from an operator.

In one embodiment, the printer comprises at least two supports for rolls of printing paper web, and means for feeding the paper web of the one roll into operative engagement with the conveying means after the cut off paper web portion of the previous roll has been discharged.

From another aspect, the present invention provides a printer comprising at least one support for a roll of printing paper web, a printer station including a print head, means for conveying a web of printing paper from the roll to the printer station, driving means adapted for selectively driving the conveying means in a downstream conveying direction or an upstream conveying direction, a cutting station provided downstream of the printer station for cutting the printing paper web, means for detecting the passage of an end location on the end portion of the printing paper supplied from the roll and conveyed in downstream direction to the printer station, controlling means for controlling the print head including means for entering and storing a printing job, the controlling means further including means for receiving a signal from the detecting means indicating the passage of the end location of the roll of paper web and interrupting the printing job to allow removal of the paper web portion upstream of the printer station, wherein the controlling means are adapted to operate the print head to restart the interrupted printing job for a subsequent roll of printing paper web after the removal of said paper web portion of the previous roll.

From a further aspect, the present invention provides a printer comprising at least one support for a roll of printing paper web, a printer station including a print head, means for conveying printing paper web from the roll to the printer station, driving means adapted for selectively driving the conveying means in a downstream conveying direction or an upstream conveying direction, a cutting station downstream of the printer station for cutting the printing paper web, means for detecting the passage of an end location on the end portion of the printing paper supplied from the roll and conveyed in downstream direction to the printer station, controlling means for controlling the print head including means for entering and storing a printing job, the controlling means further including means for receiving a signal from the detecting means indicating the passage of the end location of the roll of the paper web, means for determining a first length of paper web present between the detecting means and the print head, means for determining a second length of paper web required for completing the printing job being performed when the controlling means receives said signal, means for comparing the first and the second length, wherein the controlling means are adapted for controlling said conveying means depending on the result of said comparison and, in case the second length is larger than the first length, to stop the driving means and to interrupt the printing job and to hold the printed paper web upstream of the cutting means for a drying period, and after that drying period to operate the driving means again for conveying the dried paper web portion located upstream of the cutting means in the upstream direction to discharge it from the printer.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will be described on the basis of an exemplary embodiment shown in the attached drawings, wherein.

DETAILED DESCRIPTION OF THE INVENTION

Figure 1:
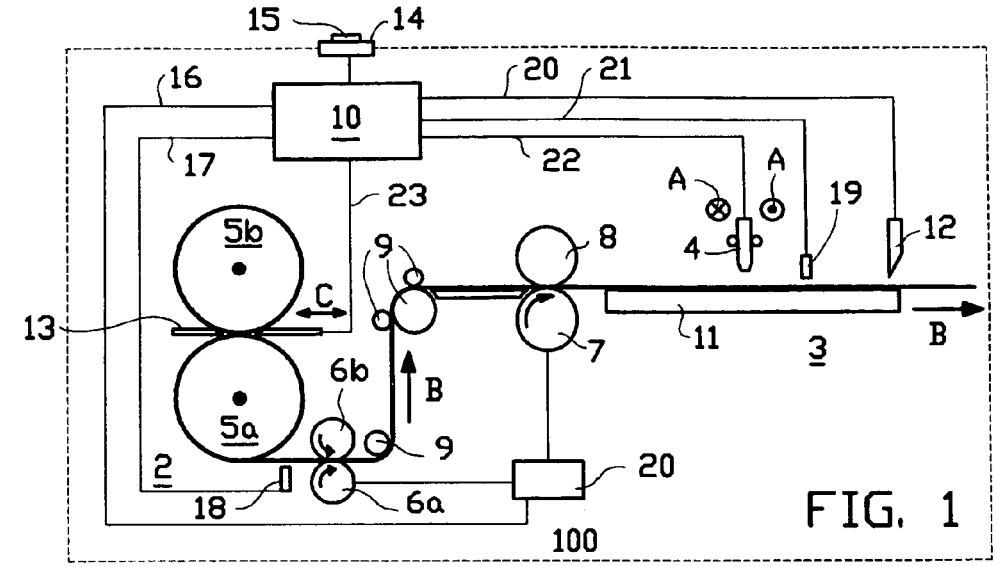
FIG. 1 shows a schematic front view on a printer according to the present invention, showing relevant parts only, during normal operation.
Figure 2:
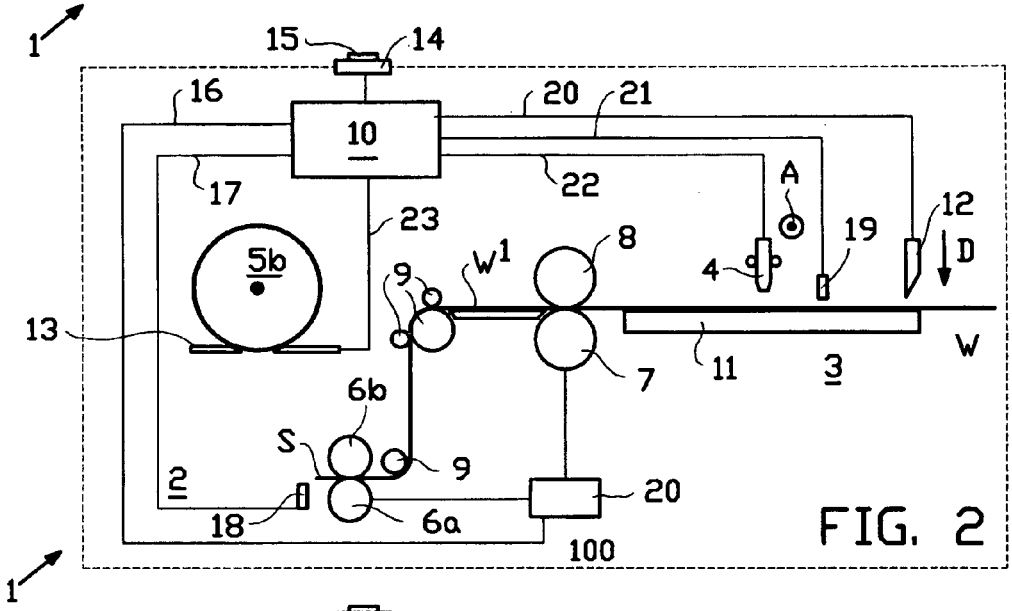
FIG. 2 shows the printer of FIG. 1, in a stage of detected end of roll.
Figure 3:
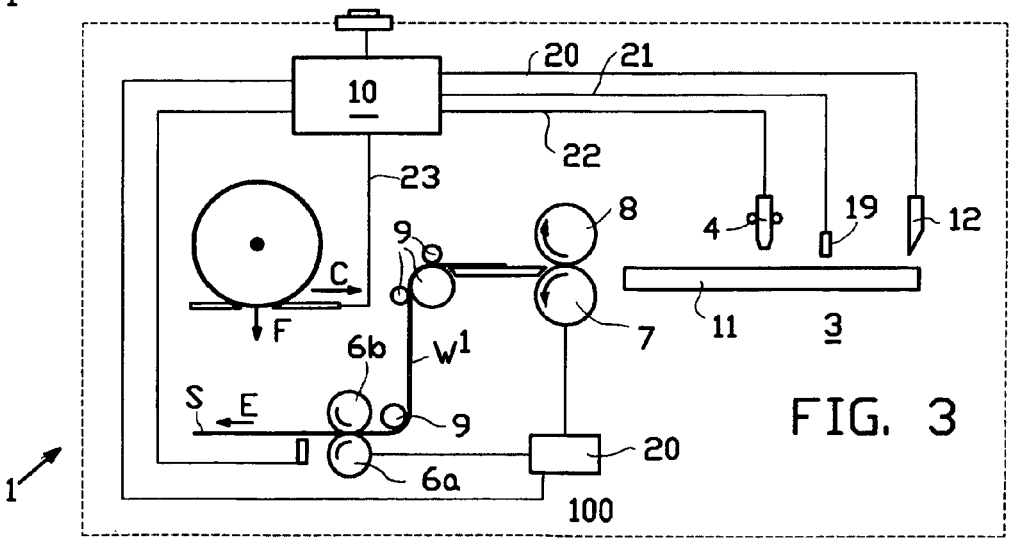
FIG. 3 shows the printer of FIGS. 1 and 2, during discharge of the end portion of the paper web.

In FIGS. 1–3 a printer 1 is schematically shown, which printer 1 comprises a frame 100 in which a web supply station 2 and a printer station 3 can be recognized.

The printer station 3 comprises a print head 4 which is movable back and forth in the direction A. The print head 4 is arranged above a printer table 11, at the right hand end of which a paper cutter 12 has been positioned.

In the supply station 2 two rolls 5*a,b* of paper web W have been arranged above one another, the upper roll 5*b* being supported by retractable supports 13. The lower paper roll 5*a* is supported by means that are not shown, and is unwound in the direction of the curved arrow to supply paper web W in the direction B.

For conveying the paper web W from the supply station 2 to the printer station 3, two driving rolls 6*a,b* have been arranged at a short distance downstream of the roll 5*a*, and in addition a drive/pressure roll assembly 7, 8 has been arranged at a short distance upstream of the printer table 11. Both sets of rolls 6*a,b* and roll 7 are driven by motors that are not shown, which motors are controlled by drive means 20, which in turn are controlled by a central control unit 10 arranged in the printer 1. These drive means 20 are operatively connected to the central control unit 10 by line 16.

Located between the supply roll 5*a* and the drive rolls 6*a,b* is an "end of roll" detector 18, such as a photosensor, for detecting the passage of the end edge of the paper web which is wound on roll 5*a*. The detector 18 is operatively connected to the central control unit 10 by a line 17.

The roll holders 13 are movable in the directions C, by driving means that are not shown, which are operatively connected to the central control unit 10 by line 23.

A sensor 19 for sensing the degree of drying of the ink pattern arranged on the paper web W by print head 4 is positioned downstream of the print head 4 and is operatively connected to the central control unit by line 21. Likewise, the cutter 12 is operatively connected to the central control unit 10 by line 20.

The printer 1 is furthermore provided with a control panel 14, having buttons and the like for entering data into the central control unit 10. The central control unit 10 can furthermore be connected to a data station providing instructions regarding the printing jobs to be carried out by the printer 1.

In the situation depicted in FIG. 1 the paper web W is unwound from roll 5*a* and printed by the print head 4, according to a sequence of printing jobs entered in the control unit 10.

In FIG. 2, the situation is shown in which the roll 5*a* has been unwound completely, and the end edge S has passed beyond the detector 18. A corresponding signal is provided through line 17 to the central control unit 10, and almost immediately the central control unit 10 commands the drive means 20 through line 16 to stop the driving of the rolls 6*a,b* and 7. The end edge portion of the web B will then still be engaged between the rolls 6*a,b*.

In addition the control unit 10 ceases to activate the print head 4, and the web on the printer head is moved to a stationary waiting position alongside the printer table 11. The position shown in FIG. 2 is maintained for a period of time to allow the ink to dry, with or without using additional drying means (not shown). After waiting awhile, which in the case of hotmelt inks is several minutes, the sensor 19 senses that the ink has dried to a sufficient degree, and a signal is provided to the central control unit 10 through line 21.

Then the central control unit 10 activates the cutter 12 through line 20, so that the cutter 12 will be moved downwards in direction D to separate the paper web portion W' which is present upstream of the cutter 12 from the web located downstream of the cutter 1.

Next, as shown in FIG. 3 the central control unit 10 controls the driving means 20 to let the rolls 6*a,b* and 7 rotate in the counter direction. As a result, the web portion W' will be moved backwards, towards the supply station 2, and is discharged in direction E.

After the web W' has been discharged, in this way automatically, sensed by a further sensor/detector (not shown) the central control unit 10 activates the drive means for the roll holders 13 through line 23, to move away from each other in direction C, so as to allow the roll 5*b* to move downwards in direction F in order to take the position of roll 5*a* as shown in FIG. 1. Means known in the art are provided for entering the leading end of the web W wound on roll 5*b* into engagement with the drive rolls 6*a,b*.

The central control unit 10 then activates the print head 4 again when the leading end of the paper web W has arrived on the printer table 11. The control unit 10 is adapted such that the printing job which was performed when the detector 18 detected the end edge S is put first in the queue of remaining printing jobs, so that that job will be performed first.

Figure 4:
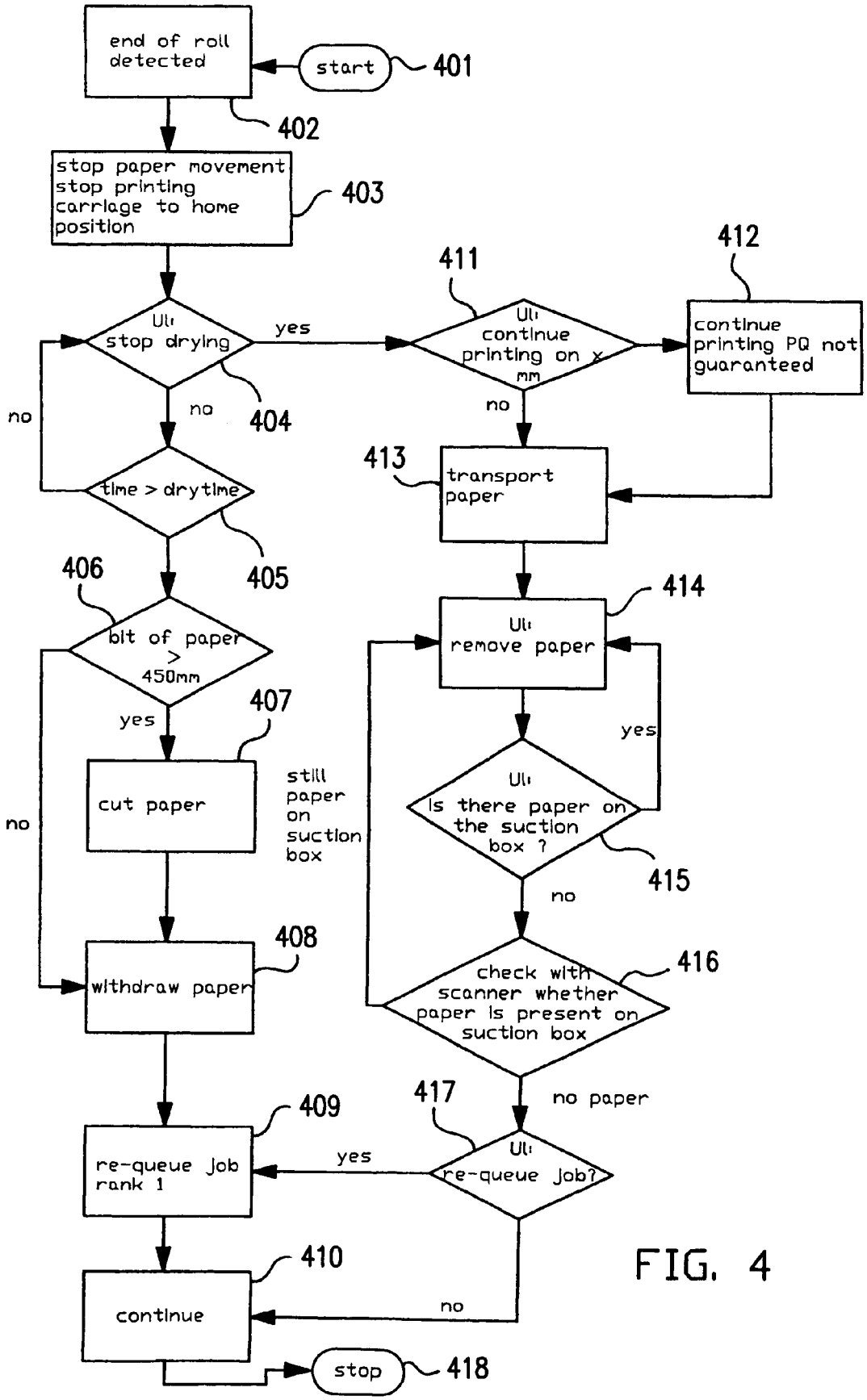
FIG. 4 shows a flow chart of the operation of the printer of FIGS. 1–3.

FIG. 4 shows a short flow chart of the present process. The end of roll behaviour in an unattended and attended mode in the printing process starts in 401 with step 402 by the "end of roll detected" event of detector 18 due to the fact that the end edge S has passed beyond the detector 18 and the process continues in the next step 403 wherein the printing process stops after printing the current print swath, the paper movement stops, and the printing carriage moves to the home position and stops.

In the next step 404, the printer user interface indicates "stop drying?" and the printer may decide automatically to wait for drying of the paper (no), and the printer operator may intervene on the control panel 14 to stop drying the paper, as explained later. In step 405 the printer is in the unattended operator mode and checks for whether the time needed for drying the printed matter is expired, so when time<dry time (no) the process continues at step 404. When time>dry time (yes) then the next step 406 is executed. The drying time may depend on the kind of paper.

In step 406, when the bit of paper >405 mm (yes), then the paper is out with cutter 12 in the next step 407 and thereafter in step 408 the paper upstream is withdrawn by rotating, in counter direction, rolls 6*a, b* and 7 and leading the paper towards the supply station 2, and discharging the paper in direction E such that the paper path does not contain paper anymore. Otherwise, when there is a bit of paper <450 mm (step 406, no) then in the next step 408 the paper is withdrawn immediately without cutting the paper. Thereafter the printing job which is performed when detector 18 detected the paper end edge S is put first, at rank 1, in the queue of the remaining printing jobs in step 409. Finally the print process can continue in step 410 to print on an available paper roll automatically. When appropriate the next paper roll, for example roll 5*b* is used to supply paper for the print job.

When in step 404 the printer operator intervenes to stop immediately the drying of the paper (yes) by means of control panel 14, the process enters the attended printing mode and the process continues in step 411. Step 411 puts on the user interface the indication "continue printing on x mm?" The printer user interface indicates the length x of paper available for printing the remainder of the print job.

The operator may command via the operator panel to continue printing on x mm of the current print job (yes) and the print process continues with step 412 or the operator may command via the operator panel to stop printing (no) and the process continues with step 412. As an alternative the printer itself decides how to continue the process in step 411, depending on the printer default setting. For example, the printer decides automatically in step 411 to continue printing (yes) the print job in step 412 where the print quality (PQ) is not guaranteed or the printer decides automatically in step 411 to stop printing the print job (no) and continues the process in step 413.

After finishing the print job in step 412, where the print quality is not guaranteed, the process is continued in step 413, where the paper is transported by driving roll 7 clockwise such that the remaining paper can be removed in the next step 414 which results in a user interface indicative message to remove remaining paper from the printer table 11. After the operator has removed the remaining paper from the printer table, the operator may confirm in the next step 415 on the operator panel that the paper is removed (no) so that the process continues at step 416. Otherwise the process (yes) continues at step 414. Depending on the default printer setting the printer may decide automatically after some time in step 415 that the paper may be removed (no) and that the process continues at step 416.

The scanner checks in step 416 whether there is still paper present on the suction box (not shown) which is part of the printer table 11. When there is still paper on the suction box then the process is continued in step 414. When there is no paper on the suction box (no paper) then the process is continued in step 417 where the user interface indicates whether the print job must be re-queued to the queue. The reason to re-queue the job might be that the print quality is not good enough. The operator can command the printer by means of the operator panel to re-queue the print job (yes) resulting in step 409 where the print job is put to the first position in the queue. After the re-queue of the print job the process continues with printing the first job of the queue in step 410. Or, in step 417 the operator can command the printer by means of the operator panel to continue with the next print job (no) of the queue and the process continues in step 410. Finally, the process is finished in 418.

The printer according to the present invention is especially suited for use with photogloss paper.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printer comprising at least one support for a roll of printing paper web, a printer station including a print head, means for conveying printing paper web from the roll to the printer station, driving means adapted for selectively driving the conveying means in a downstream conveying direction or an upstream conveying direction, a cutting station downstream of the printer station for cutting the printing paper web, means for detecting the passage of an end location on an end portion of the printing paper supplied from the roll and conveyed in downstream direction to the printer station, controlling means for controlling the print head including means for entering and storing a printing job, the controlling means further including means for receiving a signal from the detecting means indicating the passage of the end location of the roll of the paper web and then to interrupt the printing job and to deactivate the driving means so as to hold the printed paper web upstream of the cutting means for a drying period, and after that drying period to operate the driving means again for conveying the dried paper web portion located upstream of the cutting means in the upstream direction to discharge it from the printer.

2. The printer according to claim 1, wherein the detecting means are adapted to detect the passage of an end edge of the paper web.

3. The printer according to claim 1, further provided with means for sensing a degree of drying of an ink present on the paper web portion to be dried, said sensing means being operatively connected to the controlling means for providing a signal indicating that the ink has dried to a sufficient degree.

4. The printer according to claim 1, wherein the controlling means are adapted to operate the print head to restart the interrupted printing job for a subsequent roll of printing paper web after the discharge of said paper web portion of the previous roll.

5. The printer according to claim 1, comprising at least two supports for rolls of printing paper web, and means for feeding the paper web of the one roll into operative engagement with the conveying means after a cut-off paper web portion of a previous roll has been discharged.

6. The printer according to claim 1, wherein the print head is adapted for delivering hotmelt ink.

7. The printer according to claim 1, wherein the controlling means is provided with means for entering data and means for determining a length of a drying period, depending on said data.

8. The printer according to claim 7, wherein the means for entering data relates to the quality of the paper and/or the ink.

9. A printer comprising at least one support for a roll of printing paper web, a printer station including a print head, means for conveying printing paper web from the roll to the printer station, driving means adapted for selectively driving the conveying means in a downstream conveying direction or an upstream conveying direction, a cutting station downstream of the printer station for cutting the printing paper web, means for detecting the passage of an end location on an end portion of the printing paper supplied from the roll and conveyed in downstream direction to the printer station, controlling means for controlling the print head including means for entering and storing a printing job, the controlling means further including means for receiving a signal from the detecting means indicating the passage of the end location of the roll of the paper web and then to interrupt the printing job and to allow removal of the paper web portion upstream of the printer station, by conveying the paperweb portion in the upstream direction wherein the controlling means are adapted to operate the print head to restart the interrupted printing job for a subsequent roll of printing paper web after the removal of said paper web portion of the previous roll.

10. A printer comprising at least one support for a roll of printing paper web, a printer station including a print head, means for conveying printing paper web from the roll to the printer station, driving means adapted for selectively driving the conveying means in a downstream conveying direction or an upstream conveying direction, a cutting station downstream of the printer station for cutting the printing paper web, means for detecting the passage of an end location on the end portion of the printing paper supplied from the roll and conveyed in downstream direction to the printer station, controlling means for controlling the print head including means for entering and storing a printing job, the controlling means further including means for receiving a signal from the detecting means indicating the passage of an end location of the roll of the paper web, means for determining a first length of paper web present between the detecting means and the print head, means for determining a second length of paper web required for completing the printing job being performed when the controlling means receive said signal, means for comparing the first and the second length, wherein the controlling means are adapted for controlling said conveying means depending on the result of said comparison and—in case the second length is larger than the first length— to stop the driving means and to interrupt the printing job and to hold the printed paper web upstream of the cutting means for a drying period, and after that drying period to operate the driving means again for conveying the dried paper web portion located upstream of the cutting means in the upstream direction to discharge it from the printer.

11. A method of printing paper web supplied from rolls in a printer which comprises:

conveying the printer paper web from a roll to a printing station;

driving the printing paper web in a downstream conveying direction or an upstream conveying direction;

cutting the printing paper downstream of the printing station;

detecting the passage of an end location on an end portion of the printing paper supplied from the roll and conveyed in the downstream direction to the printing station, controlling the print head including entering and storing a printing job and receiving a signal indicating the passage of the end location of the roll of the paper web;

interrupting the printing job and holding the printed paper web for a drying period, and after the drying period, conveying the dried paper web portion located upstream of a cutting location in the upstream direction to discharge it from the printer.

* * * * *